United States Patent [19]

Zion et al.

[11] Patent Number: 4,765,534

[45] Date of Patent: Aug. 23, 1988

[54] OCTAGONAL CARTON FOR PIZZA PIES OR THE LIKE

[75] Inventors: Kenneth J. Zion, New Lenox; Richard H. Johnson, Arlington Heights, both of Ill.

[73] Assignee: Stone Container Corporation, Chicago, Ill.

[21] Appl. No.: 74,931

[22] Filed: Jul. 17, 1987

[51] Int. Cl.[4] ..... B65D 5/20

[52] U.S. Cl. ..... 229/109; 229/149; 229/150; 229/151; 229/152; 229/154; 229/163; 229/169; 229/192; 229/195; 229/196; 229/906; 229/918

[58] Field of Search ..... 229/109, 141, 149–154, 229/163, 169, 192, 195, 196, 903, 906, 915, 918, DIG. 11, 41 C, 41 D; 426/128; 206/424

[56] References Cited

U.S. PATENT DOCUMENTS

| | | | |
|---|---|---|---|
| 285,456 | 9/1883 | Brehmer | 229/149 |
| 1,052,564 | 2/1913 | Brown | 229/149 |
| 1,767,733 | 6/1930 | Brown | 229/148 |
| 1,960,635 | 5/1934 | Kinkenon | 229/109 |
| 2,147,563 | 2/1939 | Turner | 229/109 |
| 2,646,916 | 7/1953 | Meller | 229/150 |
| 2,663,488 | 12/1953 | Gibbons | 229/152 |
| 2,784,900 | 3/1957 | Bauer | 229/149 |
| 2,819,833 | 1/1958 | Sauer | 229/41 C |
| 3,165,253 | 1/1965 | Adams et al. | 229/150 |
| 3,343,744 | 9/1967 | Morell et al. | 229/917 |
| 3,512,697 | 5/1970 | Robinson | 206/424 |
| 4,362,265 | 12/1982 | Williams | 229/43 |

FOREIGN PATENT DOCUMENTS

| | | | |
|---|---|---|---|
| 21682 | 3/1936 | Australia | 229/149 |
| 1320926 | 2/1963 | France | 229/41 C |
| 2329523 | 5/1977 | France | 229/DIG. 11 |
| 2408525 | 7/1979 | France | 229/109 |
| 2018226 | 10/1979 | United Kingdom | 229/DIG. 11 |
| 2116150 | 9/1980 | United Kingdom | 229/109 |

*Primary Examiner*—Stephen Marcus
*Assistant Examiner*—Gary E. Elkins
*Attorney, Agent, or Firm*—Silverman, Cass, Singer & Winburn, Ltd.

[57] ABSTRACT

An octagonal carton formed from an integral prescored blank having a bottom wall with at least three side walls attached thereto. An opposite pair of the side walls include diagonal corner wall structures which are foldable with the side walls to form diagonal corner walls. The lid is attached to the third wall and is foldable over the two opposite side walls and secured to a fourth side wall attached to the bottom wall or secured by a wall on the lid edge to the bottom wall to form the fourth side wall. The lid and fourth wall structures include various securing structures to secure the carton when erected.

20 Claims, 6 Drawing Sheets

FIG. 1
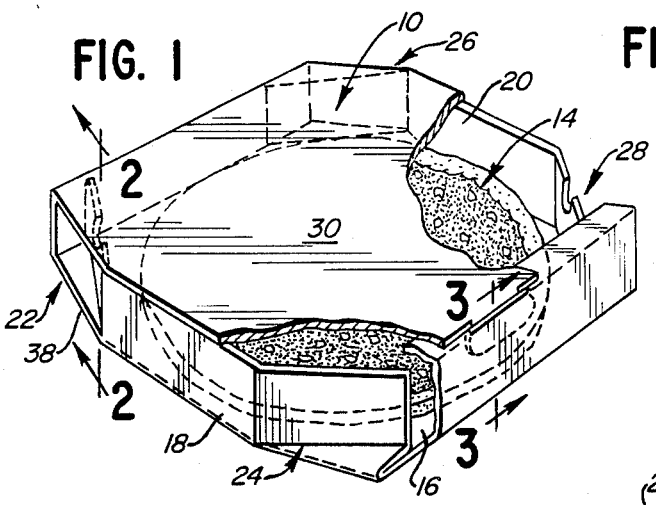
FIG. 3
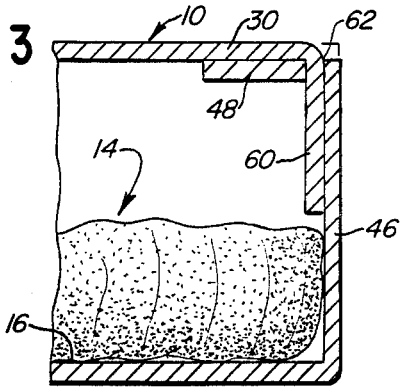
FIG. 2
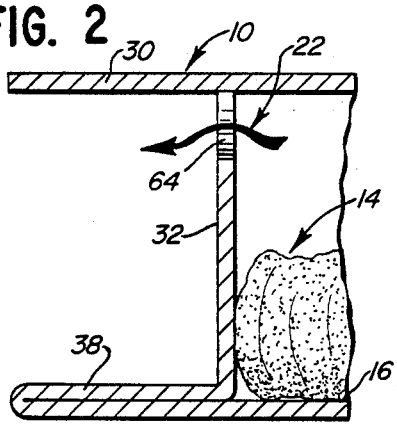
FIG. 4
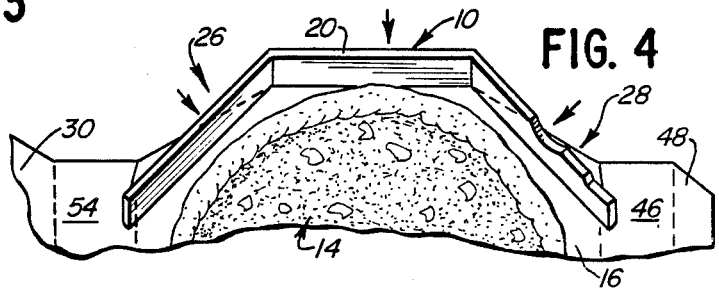
FIG. 5
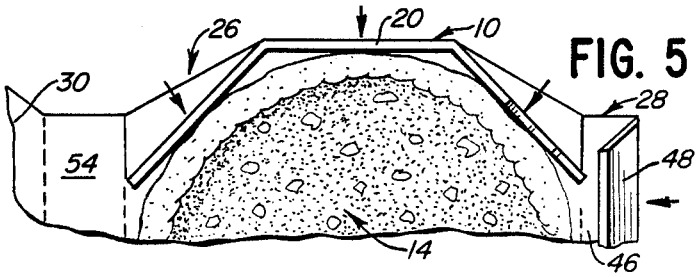
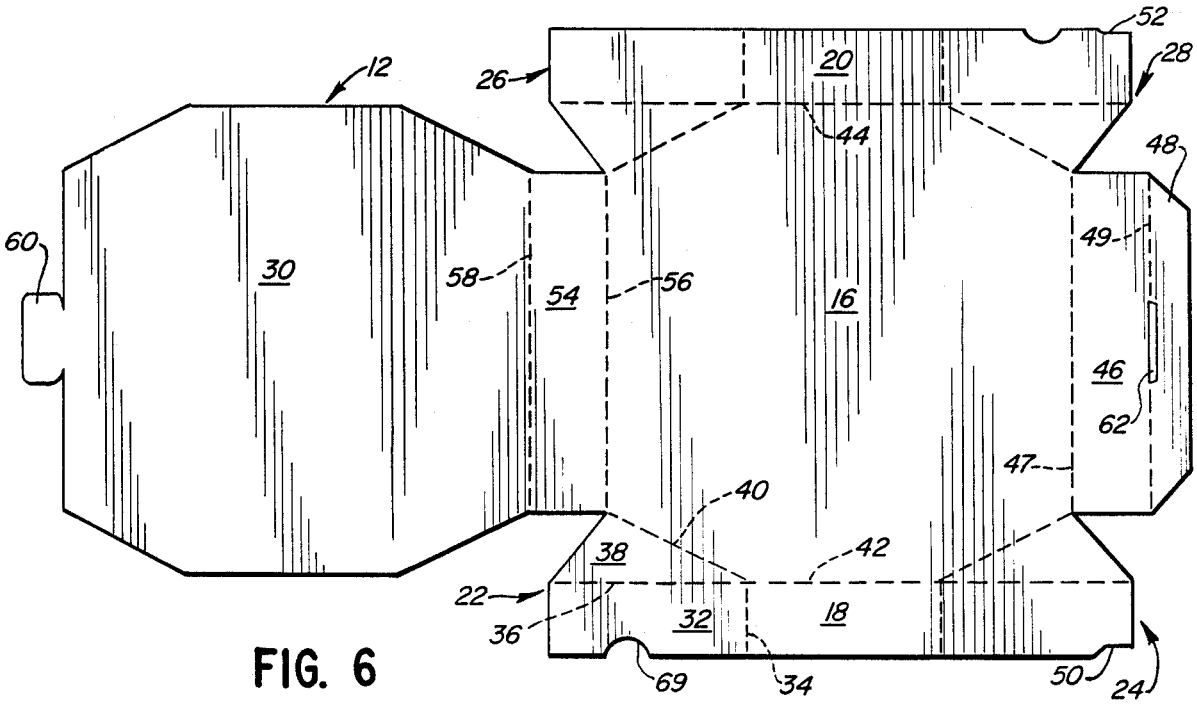
FIG. 6

FIG. 7
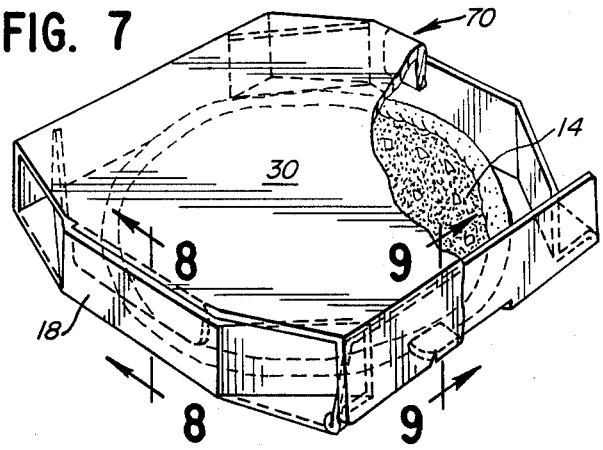
FIG. 9
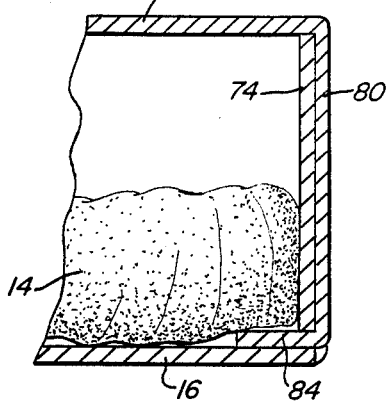
FIG. 8
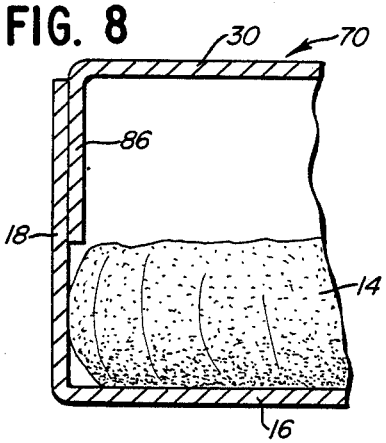
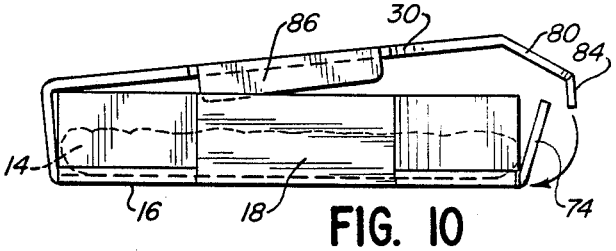
FIG. 10
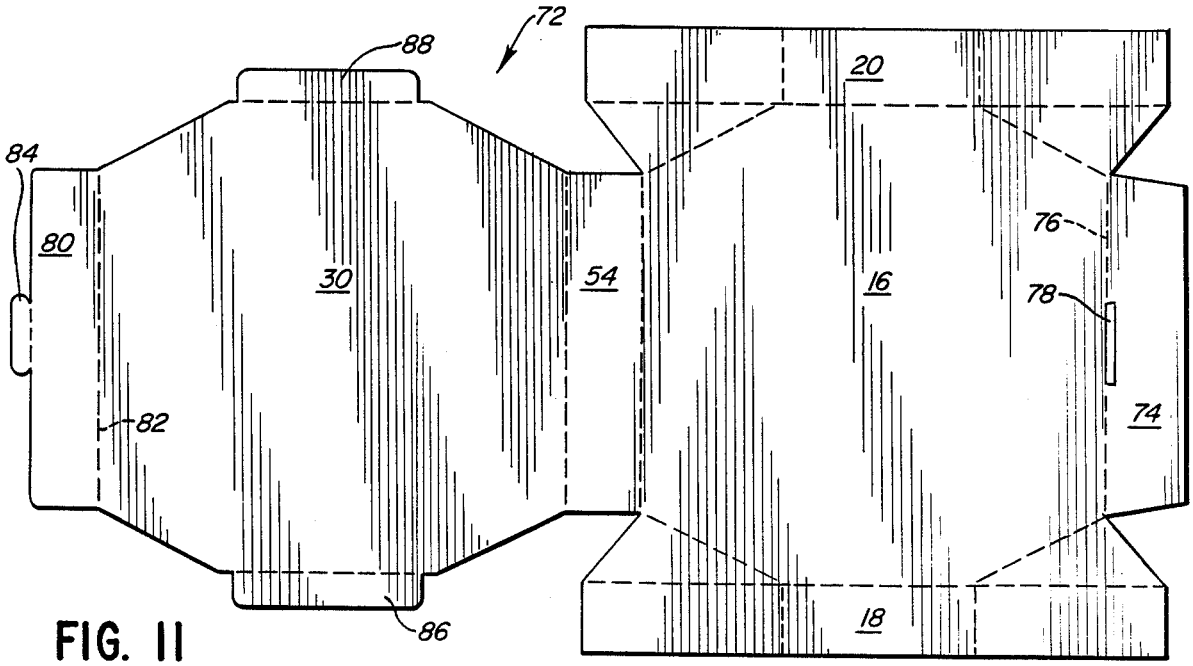
FIG. 11

FIG. 12
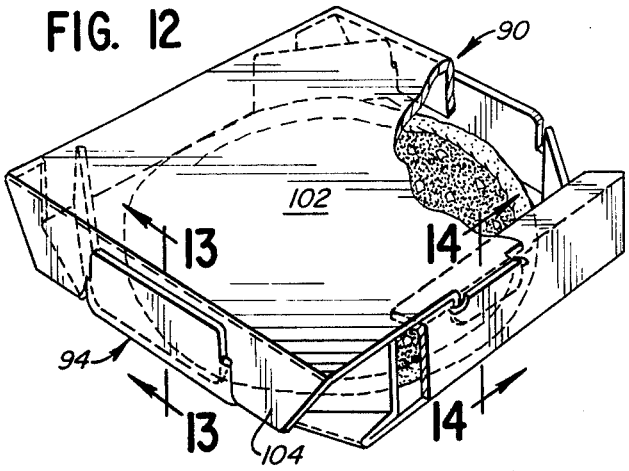
FIG. 14
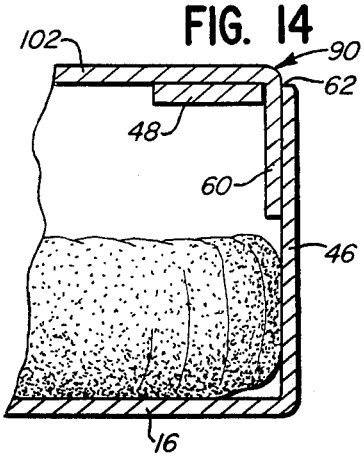
FIG. 13
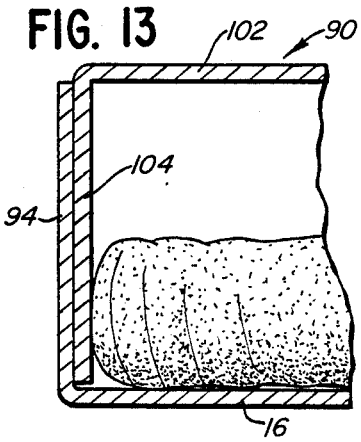
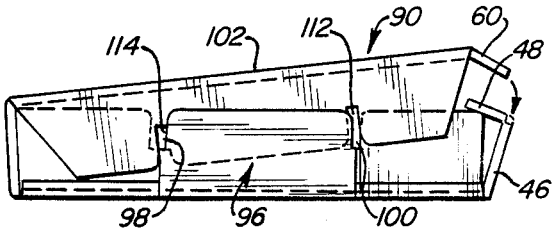
FIG. 15
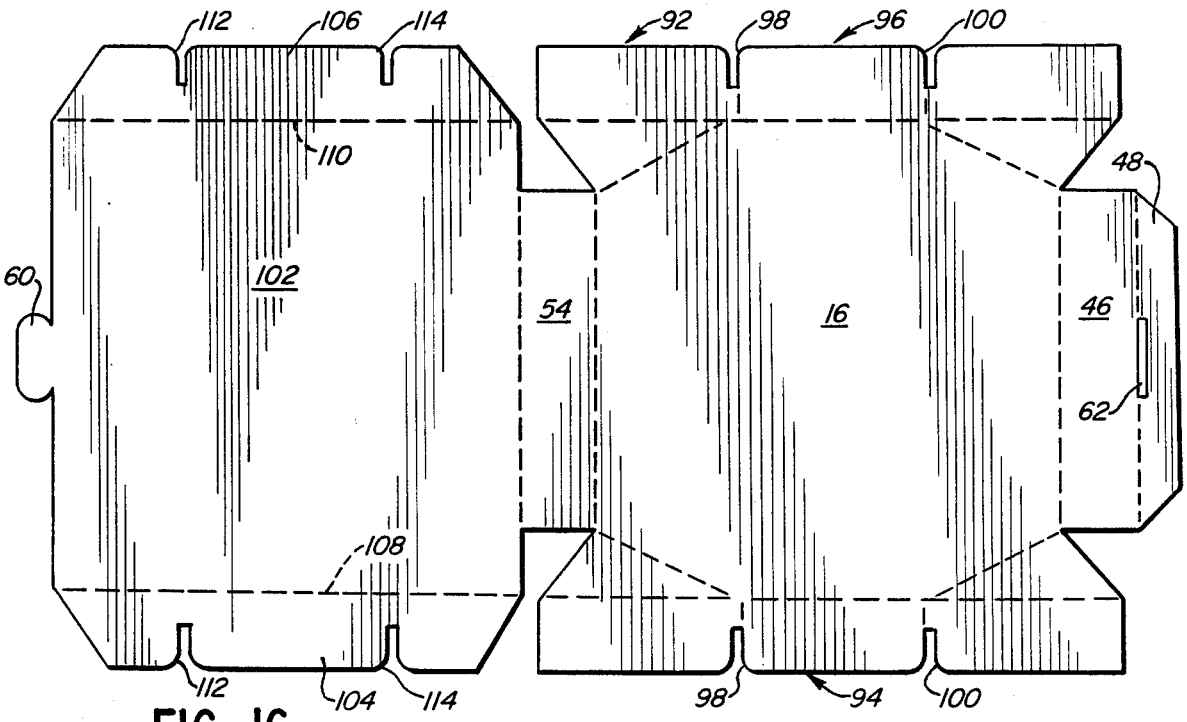
FIG. 16

FIG. 17
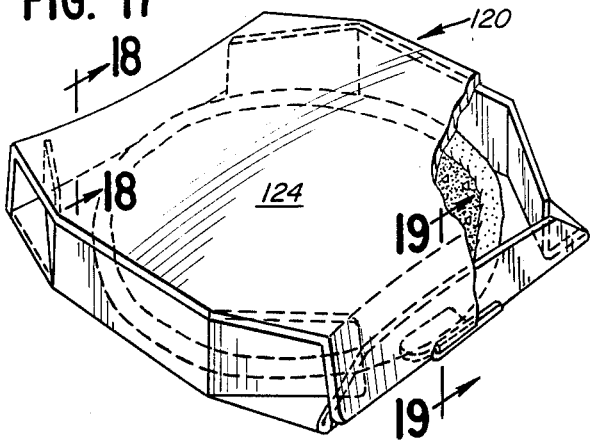
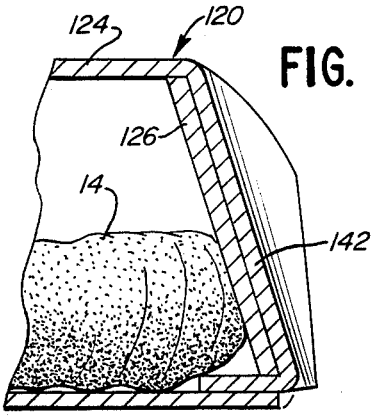
FIG. 19
FIG. 18
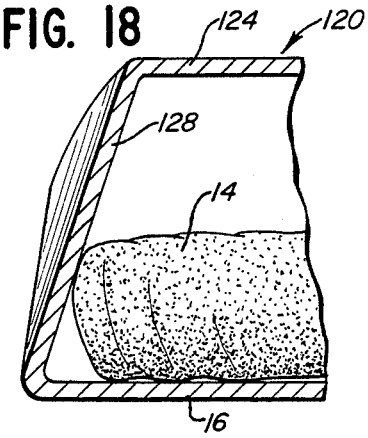
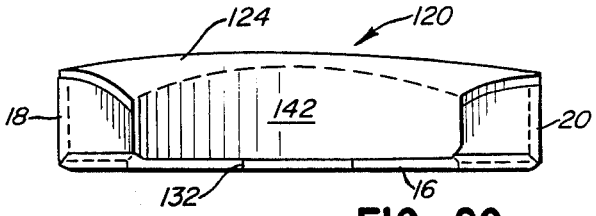
FIG. 20
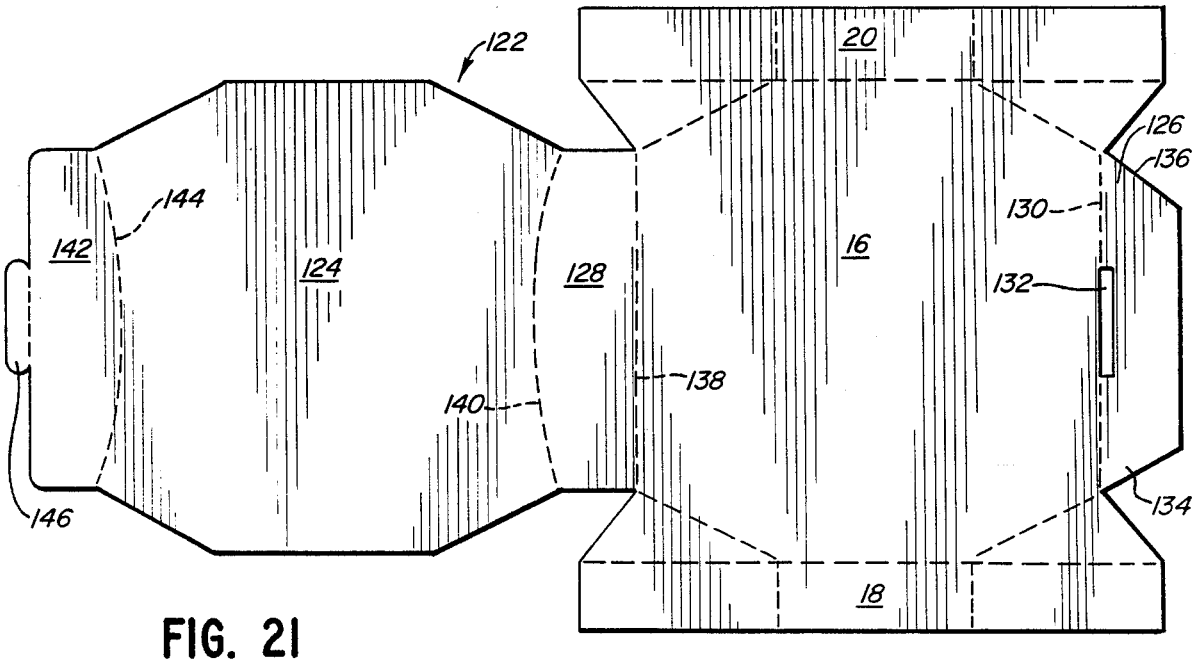
FIG. 21

FIG. 22
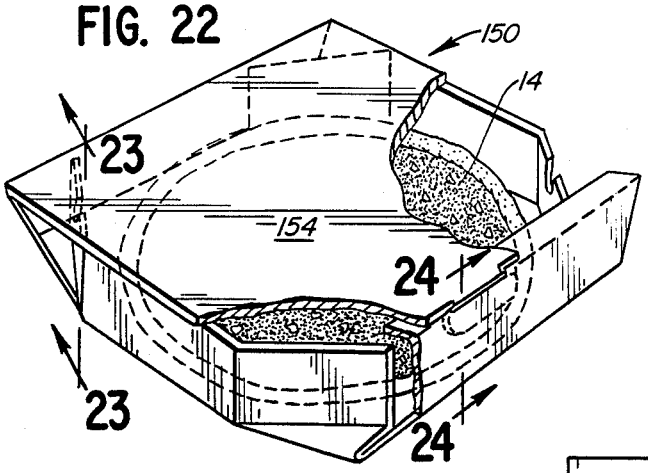
FIG. 24
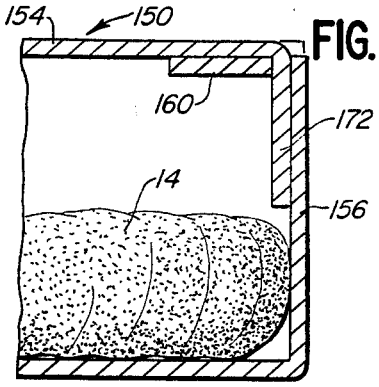
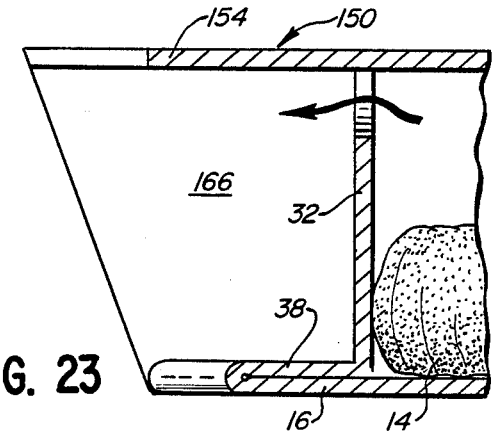
FIG. 23
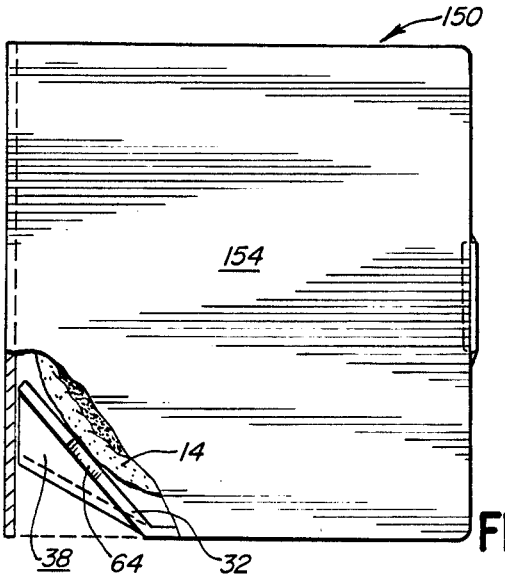
FIG. 25
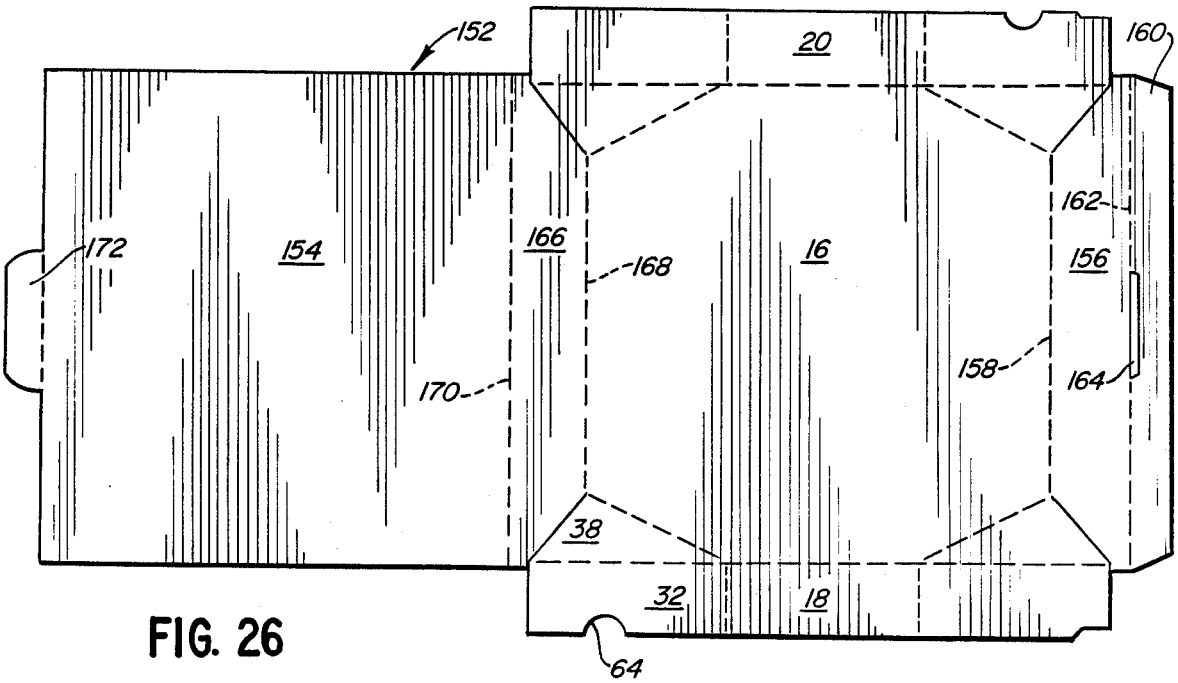
FIG. 26

FIG. 27
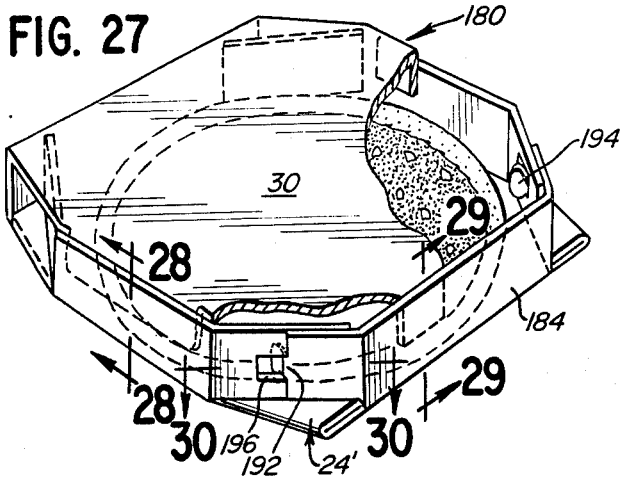
FIG. 29
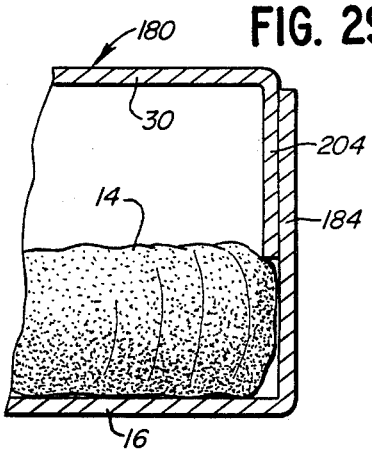
FIG. 28
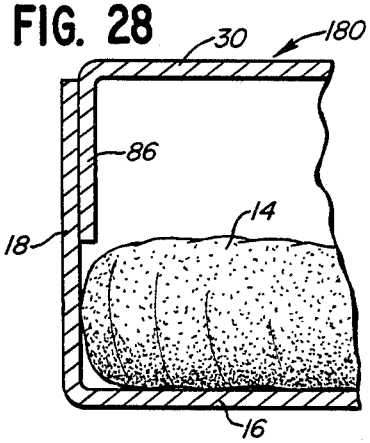
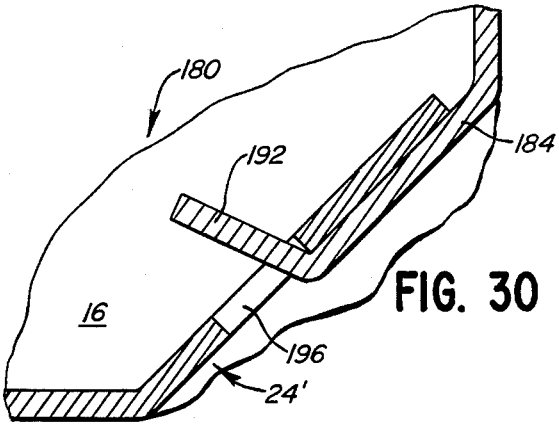
FIG. 30
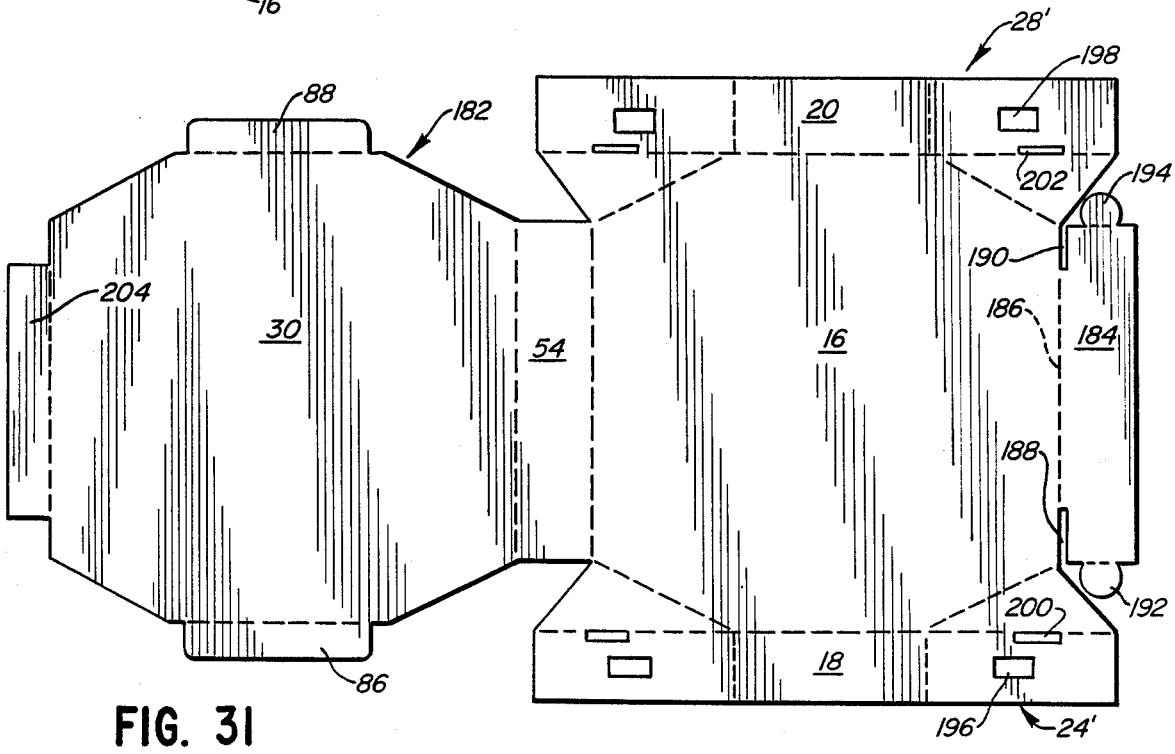
FIG. 31

OCTAGONAL CARTON FOR PIZZA PIES OR THE LIKE

BACKGROUND OF THE INVENTION

The invention relates to cartons especially suitable for packaging of flat food products such as pizza pies and more particularly relates to a carton formed from a single blank cut and scored to form an octagonal tray when erected to provide angled corner formations disposed to engage the food product for preventing undesirable displacement thereof.

Cartons or containers for packaging flat food products, such as cakes; pies or pizza pies, are well known and exist in a number of types and shapes. The conventional type of flat food product carton generally is a shallow, substantially square-configured carton sized to fit relatively closely adjacent the edge of the product when assembled. These cartons generally have relatively wide tops and bottoms which can deflect into contact with the food product. One or more of the sides of the cartons also can be unsupported so as to allow the food product to shift inadvertently, thereby further subjecting the product to damage or sticking to the carton walls.

Octagonal cartons have been developed to avoid the crushing or deflecting of the carton tops and bottoms, especially when the cartons are stacked. One such substantially octagonal carton is described in U.S. Pat. No. 3,512,697. This carton includes a tray having reinforcement corner formations at substantially 45 degree angles to alleviate crushing of the carton. The carton is formed from a blank which has a plurality of foldable panels which must be manipulated to assemble the carton. A second carton having improved crush resistance relative to the carton of U.S. Pat. No. 3,512,697 is described in U.S. Pat. No. 3,923,234. This carton utilizes a double fold corner structure to improve the resistance to crushing of the carton.

It would be desirable to have a carton according to the invention herein which can be formed into a tray of octagonal shape from an integral blank of a minimal amount of paperboard and which easily can be assembled around a pieshaped food product, such as a pizza pie. The tray has angular corner formations which engage the flat panel or sheet on which the pizza pie is carried so as to prevent lateral shifting of the food product and includes a hinged cover for closing off the open upper end of the tray. The hinged cover is provided by a single panel of the integral blank which is hingedly secured to one of the side walls of the tray independently of the said corner formations.

SUMMARY OF THE INVENTION

A carton formed from a one-piece, prescored blank foldable to form the carton into a tray having a bottom and side walls hingedly secured together and a top wall to form a cover for the tray which includes one or more securing tabs. The tray includes diagonal corner formations or walls which are attached to and fold inwardly into an upright position with a pair of the side walls. The top is hingedly secured to a third side wall and is releasably secured at least to the fourth side wall when the carton is assembled. The corner formations are constructed and arranged to engage the food product in the tray to prevent shifting thereof and to serve as support members during stacking of multiple cartons.

The cartons can be fabricated in a plurality of different sizes for different sizes of pizza pies, for instance. Further, the tray part of the carton embodying the invention can be of substantially uniform internal octagonal shape even for different carton sizes.

BRIEF DESCRIPTION OF THE DRAWINGS

FIG. 1 is a perspective view of a first embodiment of octagonal carton embodying the invention with portions broken away for illustration;

FIG. 2 is a partial side sectional view of one wall taken along line 2—2 of FIG. 1;

FIG. 3 is a partial side sectional view of one wall taken along line 3—3 of FIG. 1;

FIGS. 4 and 5 are partial top plan views of the assembly of the carton of FIG. 1;

FIG. 6 is a plan view of a carton blank which forms the carton of FIG. 1;

FIG. 7 is a perspective view of a second embodiment of octagonal carton embodying the invention with portions broken away for illustration;

FIG. 8 is a partial side sectional view of one wall taken along line 8—8 of FIG. 7;

FIG. 9 is a partial side sectional view of one wall taken along line 9—9 of FIG. 7;

FIG. 10 is a side plan view of the assembly of the carton of FIG. 7;

FIG. 11 is a plan view of a carton blank which forms the carton of FIG. 7;

FIG. 12 is a perspective view of a third embodiment of octagonal carton embodying the invention with portions broken away for illustration;

FIG. 13 is a partial side sectional view of one wall taken along line 13—13 of FIG. 12;

FIG. 14 is a partial side sectional view of one wall taken along line 14—14 of FIG. 12;

FIG. 15 is a side plan view of the assembly of the carton of FIG. 12;

FIG. 16 is a plan view of a carton blank which forms the carton of FIG. 12;

FIG. 17 is a perspective view of a fourth embodiment of octagonal carton embodying the invention with portions broken away for illustration;

FIG. 18 is a partial side sectional view of one wall taken along line 18—18 of FIG. 17;

FIG. 19 is a partial side sectional view of one wall taken along line 19—19 of FIG. 17;

FIG. 20 is a side plan view of the carton of FIG. 17;

FIG. 21 is a plan view of a carton blank which forms the carton of FIG. 17;

FIG. 22 is a perspective view of a fifth embodiment of octagonal carton embodying the invention with portions broken away for illustration;

FIG. 23 is a partial side sectional view of one wall taken along line 23—23 of FIG. 22;

FIG. 24 is a partial side sectional view of one wall taken along line 24—24 of FIG. 22;

FIG. 25 is a top plan view of the carton of FIG. 22 with a portion broken away for illustration;

FIG. 26 is a plan view of a carton blank which forms the carton of FIG. 22;

FIG. 27 is a perspective view of a sixth embodiment of octagonal carton embodying the invention with portions broken away for illustration;

FIG. 28 is a partial side sectional view of one wall taken along line 28—28 of FIG. 27;

FIG. 29 is a partial side sectional view of one wall taken along line 29—29 of FIG. 27;

FIG. 30 is a partial sectional view of one wall taken along line 30—30 of FIG. 27; and FIG. 31 is a plan view of a carton blank which forms the carton of FIG. 27.

DESCRIPTION OF THE PREFERRED EMBODIMENTS

Referring to FIG. 1, there is illustrated a first octagonal tray carton embodiment of the invention designated generally by the reference numeral 10. The carton or box 10 is formed by folding a prescored blank 12 illustrated in FIG. 6. The blank 12 is designed to be assembled manually to form a tray 13 around a generally circular pie type food product, here illustrated as a pizza pie 14. The pie product is illustrated as supported on a flat pan or sheet 15, although such a flat sheet 15 is not always employed.

The pizza pie 14 on pan 15 rests on bottom wall 16 of the tray 13, which will have been erected in a manner to be described subsequently herein. A pair of side walls 18 and 20 each have a pair of respective corner structures 22 and 24, 26 and 28 which are folded to form diagonal corner walls to support a cover or top wall 30. Each of the corner wall structures 22, 24, 26 and 28 is substantially identical, so that a detailed description of corner wall structure 22 will suffice to explain the operation of the other corner wall structures.

The corner wall structure 22 includes a wall portion 32 having a pair of fold lines 34 and 36. The wall portion 32 is joined to the bottom wall 16 by a triangular portion 38 joined along one side to the portion 32 at the fold line 36 and to a second side to the bottom wall 16 by a fold line 40. When the walls 18 and 20 are erected by folding them upwards along respective fold lines, as illustrated in FIGS. 1, 4 and 5, the corner wall structure 22 is erected so that the portion 38 is folded substantially flat against the bottom wall 16. This results in the wall portion 32 being erected substantially perpendicular to the bottom wall 16 (FIG. 2). The folding of wall 20 and side wall corner structures 26 and 28 is best illustrated by the arrows in FIGS. 4 and 5.

To complete the carton 10, a third side wall 46 is folded up against the corner wall structures 24 and 28 along a fold line 47. A flap 48 then is folded along a fold line 49 over the wall portions of the structures 24 and 28, which includes respective notches 50 and 52 to accommodate the thickness of the flap 48.

A fourth wall 54 is folded in a like manner along a fold line 56 against the wall portion of the corner structures 22 and 26. The wall 54 is attached to the top wall or cover 30 along another fold line 58. The cover 30 includes a tab or tongue 60 to be inserted into a slot 62 formed along the fold line 49 for securely closing the tray 13 of carton 10 together with all of the walls restrained against outward movement.

The size of the carton 10 and hence tray 13 is designed to accommodate particular pizza pie diameters. One or more of the corner wall structures, such as the wall 32, can include an air vent or opening 64, to allow heated air to escape from the carton 10 (FIG. 2). The pan 15 of the pie product will be restrained from undesirable lateral movement by the said corner structures and the same objective is achieved where the food product is not on a sheet 15.

A second carton embodiment of the invention is designated generally by the reference numeral 70 in FIG. 7. The second carton 70 is formed by folding a prescribed blank 72 illustrated in FIG. 11. The carton 70 is substantially identical to the carton 10 in numerous respects and the like walls or wall portions will not again be separately described, but the same reference numerals will be utilized. The carton 70 is again illustrated as providing a shallow tray formed around the pizza pie 14.

Closing of the tray to complete the carton 70 is achieved with a different latching or locking mechanism. Further, the cover 30 includes additional reinforcement means. A third side wall 74 is connected to the bottom wall 16 along a fold line 76 having a slot 78 therealong. The top wall 30 includes another third wall 80 attached thereto along a fold line 82. The wall 80 is folded down overlapping the wall 74 and secured thereto by a tab 84 extending from the wall 80 through the aforementioned slot 78.

The free edges of the cover 30 each include side flaps 86, 88. As the carton 70 is erected, the flaps 86 and 88 are inserted inside the respective side walls 18 and 20 to add further structural integrity to the assembled carton 70.

A third carton embodiment of the invention is best illustrated in FIG. 12 and generally designated by the numeral 90. The carton 90 is formed by folding a blank 92 illustrated in FIG. 16. The bottom wall 16, third side wall 46 and flap 48 are substantially identical to corresponding walls of the carton 10.

The carton 90 also includes a pair of side wall and corner structures 94 and 96 which are substantially identical to those of the carton 10, with the addition of a pair of slots or notches 98, 100 at the edges of the side wall portions of the structures 94 and 96.

The carton 90 includes a top wall or cover 102 which includes interlocking side wall portions 104 and 106 connected to the free edges thereof along respective fold lines 108 and 110. The side wall portions 104 and 106 include a pair of slots or notches 112 and 114 which interlock with the notches 100 and 98 when the carton 90 is erected (FIGS. 12, 13 and 14). The interlocking walls 94 and 104 and 96 and 106 provide a very rigid carton 90. The walls 104 and 106 are shown as being of the same height as the walls 94 and 96, however, only one set of the walls need be the same height as the walls 46 and 54.

A fourth carton embodiment of the invention is designated generally by the reference numeral 120 in FIG. 17. The carton 120 can be formed by folding a prescored blank 122 illustrated in FIG. 21.

The carton 120 has substantially the same side wall structures 18 and 20 as the carton 10, but has a modified top lid 124, third side wall 126 and fourth side wall 128 to form the carton 120 with a pair of inclined walls 126 and 128. The inclined walls 126 and 128 bear against the edges of pizza pie 14 (FIGS. 18 and 19) to further assist in maintaining the integrity of the pizza pie 14 by not allowing it to move inside the erected carton 120.

The wall 126 is attached to the bottom wall 16 along a fold line 130 and includes a securing tab slot 132 formed along the line 130. The wall 126 preferably is not of the height of the side walls 18 and 20 and has inclined side wall edges 134 and 136.

The wall 128 is attached to the bottom wall 16 along a fold line 138 and is attached to the lid 124 along an arcuate fold line 140. The lid 124 includes a depending securing wall 142 which is attached to the lid also along an arcuate fold line 144 and includes a securing tab 146.

The lid 124 is folded over the walls 18 and 20, with the wall 142 overlapping the wall 136 and the tab 146 inserted into the slot 132 to secure the carton 120 (FIG. 17). The free corners of the corner structures of the side walls 18 and 20 can also have inclined edges to accommodte the arcuate top lid 124, which bears against the walls 18 and 20 when the carton 120 is erected.

A fifth carton embodiment of the invention is best illustrated in FIG. 22 and is designated generally by the numeral 150. The carton 150 can be erected by folding a blank 152 illustrated in FIG. 26. The carton 150 is substantially the same as the carton 10, but is modified to have a square lid structure 154.

The bottom wall 16 and side walls 18 are identical to the walls of the carton 10. A third side wall 156 is attached to the bottom wall 16 along a fold line 158. The wall 156 includes a flap 160 attached thereto along a fold line 162. The flap 160 includes a slot 164 formed therein along the line 162. The wall 156 is cut to extend in width substantially to the width of the lid 154. The flap 160 can have inclined outer edges if desired.

A fourth side wall 166 is attached to the bottom wall 16 along a fold line 168 and is attached to the lid 154 along a fold line 170. The lid 154 includes a securing tab 172 which is inserted into the slot 164 when the carton 150 is erected.

Referring to FIG. 27, a sixth carton embodiment is designated generally by the reference numeral 180. The carton 180 can be erected from a blank 182 illustrated in FIG. 31. The carton 180 can be partially preassembled, if desired, before adding the pizza pie 14 and closing the lid.

The carton 180 includes the side walls 18, 20 and 54 along with the bottom wall 16 and the top 30 which are the same as the walls and top of the carton 10. The top cover 30 includes the side tabs 86 and 88 which are the same as the carton 70.

A third wall 184 is attached to the bottom wall 16 along a fold line 186. The wall 184 includes a pair of slots 188, 190 along the outer edges of the wall 184 along the line 186. The ends of the wall 184 include respective locking tabs 192 and 194.

The modified corner structures 24' and 28' include respective tab openings 196 and 198. The structures 24' and 28' also can include slots 200, 202 in the wall fold lines to accommodate the ends of the wall 184 when the tabs 192 and 194 are secured into the tab openings 196 and 198 (FIGS. 27 and 30). Thus, utilizing the tabs 192 and 194 and the openings 196 and 198, the carton 180 can be erected prior to placing the food product therein, if desired, since the tab locking structure will maintain the walls 18, 20 and 184 erect.

Once the food product is placed into the tray part of the semi-erected carton, the cover 30 is folded over erecting the wall 54 and the carton 180 is secured by inserting the tabs 86 and 88 inside the walls 18 and 20. At the same time a tab 204 attached to the top 30 is inserted inside the wall 184 (FIG. 29).

All of the carton embodiments of the invention feature a shallow tray of octagonal configuration derived from the angled corner structures described. The planar size of the bottom wall of the tray in relation to the corner structures provides a storage area for the pizza pie designed to permit the corner structures to engage the pan or sheet 15 on which the pizza pie is placed or the pizza pie where no pan or sheet 15 is used. The tray part 13 is erected to form the corner structures free and clear of the cover or top wall of a carton. With the pizza pie in place in the tray, the cover panel is easily pivoted to overlie the tray and be locked in place, thereby completing erection of the carton embodying the invention. Of course, the corner structures still can provide stacking strength for the carton.

Modification and variations of the present invention are possible in light of the above teachings. It should be appreciated that the labels applied to each of the walls and the order of describing them is arbitrary. Further, the respective sizes illustrated are also examples and many other combinations of sizes of walls and flaps are possible within the scope of the invention. There can be more then one securing tab and slot if desired and the securing means utilizing the lid and side wall tabs and flaps can be implemented in numerous combinations. Although the carton has been illustrated as square for utilization with a round food product, it also can be rectangular to accommodate other food products. Further, it is contemplated that the corner or diagonal walls can be provided as a pair only, instead of at all four corners. Thus, the corners or diagonal walls can be formed only along one of the end walls 54 or 46 of blank 22. It is therefore to be understood that within the scope of the appended claims, the invention may be practiced otherwise than as specifically described.

What is claimed and desired to be secured by Letters Patent of the United States is:

1. A shallow carton for flat food products, such as pizza pies formed from a one-piece paperboard board blank to provide an octagonal tray having a bottom wall, a pair of upstanding opposing side walls, a third upstanding standing wall having a cover hingedly connected thereto at one end of the tray and a fourth wall attached at least to said cover or bottom wall opposite said third wall, each of said side walls having foldable panel means at opposite ends thereof disconnected from said third and fourth walls and connected to said bottom wall and one of said side walls forming four diagonal corner walls for the tray of the erected carton, said cover being foldable to overlie said walls to close the carton.

2. The carton as defined in claim 1 wherein each said means include a first wall portion connecting to and extending from said side wall to form said diagonal wall and a triangular connecting portion connected to said first wall portion along one edge thereof and connecting said first wall portion to said bottom wall along a second edge thereof and having a free edge opposite said connection with said side wall, said triangular portion foldable onto said bottom wall when erecting said carton and supporting said diagonal corner wall.

3. The carton as defined in claim 1 wherein said cover further includes diagonal corners to form a carton having both an octagonal shaped top and bottom wall.

4. The carton as defined in claim 1 including means for securing said cover to said fourth wall when said carton is closed.

5. The carton as defined in claim 4 wherein said securing means include said fourth wall having a flap along the free edge thereof and having at least one securing slot in said flap and said cover having a securing tongue extending from a free edge thereof to be engaged in said slot.

6. The carton as defined in claim 5 wherein each of said diagonal walls adjacent said flap include a notch in one edge thereof to accommodate the thickness of said flap when said carton is closed.

7. The carton as defined in claim 5 wherein said pair of side walls further include securing slots adjacent each end thereof between said side walls and said diagonal corner walls and opening from a free edge of said side walls; said cover further includes a pair of side wall portions with a pair of slots aligned with and engageable with said side wall slots to interlock said cover side wall portions with said opposite side walls when said cover closes said carton.

8. The carton as defined in claim 4 wherein said securing means include said fourth wall having at least one securing slot adjacent said bottom wall, said cover having an overlying wall portion extending from a free edge thereof with a securing tab extending from said wall portion aligned to be engaged into said slot when said cover is closed to secure said carton.

9. The carton as defined in claim 8 wherein said cover further includes side tabs on opposite sides thereof aligned with and engageable inside of said pair of opposing side walls when said cover is closed to secure said carton.

10. The carton as defined in claim 8 wherein said cover is attached to said third wall along an arcuate fold line and said overlying wall portion is attached to said lid along a second arcuate fold line to form a carton with inclined side walls when said cover is closed to secure said carton.

11. The carton as defined in claim 1 wherein said cover is rectilinear in configuration having side edges substantially parallel with said erected side walls to form a carton having an octagonal shaped bottom wall and a square top.

12. The carton as defined in claim 1 wherein said fourth wall is attached opposite said third wall and has securing tabs at each end thereof which are engageable into securing openings formed in adjacent corner diagonal walls when said pair of side walls and said fourth wall are erected to form a partially erected carton.

13. The carton as defined in claim 12 wherein said cover includes tabs along the free edges thereof which are engageable inside of said pair of side walls and said fourth wall when said lid is closed to secure said carton.

14. An intergral paperboard blank adapted to be selectively folded to form an octagnal tray open at an upper end and a hinged cover adapted to be folded to overlie said open upper end and secure the carton in a closed condition, said balnk in cluding a bottom wall panel, a pair of side wall panels hingedly secured along opposite side edges of the bottom wall, a first end wall panel hingedly secured along a third side edge of the bottom wall having a cover panel hingedly secured thereto along an edge thereof opposite the said third edge, a second end panel hingedly connected to an edge of the cover or bottom wall, said side wall panels each having corner panel formations at opposite ends thereof clear of said end panels constructed and arranged to be folded into four diagonal corner formations to render the tray octagonal when the blank is folded to erect the carton, each said corner panel formation being connected to said side wall panels and said bottom wall panel.

15. The blank defined in claim 14 in which said bottom wall has a slot in the hinge line with said second end panel and said cover panel has a tongue along an edge thereof for engaging in said slot to secure the erected carton in a closed condition.

16. The blank defined in claim 14 in which said cover panel and side wall panels have cooperating panel and slot formations aligned to be engaged when the carton is erected.

17. The blank defined in claim 14 in which said cover panel has laterally extending flaps located to be engaged against the side walls on the interior of the tray in the erected condition of the carton.

18. The blank defined in claim 14 in which said cover panel is rectangular in configuration.

19. A shallow carton for flat food products, such as pizza pies formed from a one-piece paperboard blank to provide an octagonal-like tray having a bottom wall, a pair of upstanding opposing side walls, a third upstanding wall having a cover hingedly connected thereto at one end of the tray and a fourth wall attached at least to said cover or bottom wall opposite said third wall, each of said side walls having at least one foldable panel means at opposing facing ends thereof disconnected from said third and fourth walls and connected to said bottom wall and one of said side walls forming diagonal corner walls for the tray of the erected carton, said cover being foldable to overlie said walls to close the carton.

20. An integral paperboard blank adapted to be selectively folded to form an octagonal tray open at an upper end and a hinged cover adapted to be folded to overlie said open upper end and secure the carton in a closed condition, said blank including a bottom wall panel, a pair of side wall panels hingedly secured along opposite side edges of the bottom wall, a first end wall panel hingedly secured along a third side edge of the bottom wall having a cover panel hingedly secured thereto along an edge thereof opposite the said third edge, a second end panel hingedly connected to an edge of the cover or bottom wall, said side wall panels each having corner panel formations at opposing facing ends thereof clear of said end panels constructed and arranged to be folded into a pair of diagonal corner formations to render the tray octagonal-like when the blank is folded to erect the carton, each said corner panel formation being connected to said side wall panel and said bottom wall panel.

* * * * *